United States Patent [19]

Ranalli

[11] Patent Number: 4,993,090

[45] Date of Patent: Feb. 19, 1991

[54] BABY BLANKET FOR USE IN CAR SEAT

[76] Inventor: Tracey L. Ranalli, 1263 Alice Dr., Santa Clara, Calif. 95050

[21] Appl. No.: 518,039

[22] Filed: May 2, 1990

[51] Int. Cl.[5] ..... A47G 9/02

[52] U.S. Cl. ..... 5/482; 5/494; 2/69

[58] Field of Search ..... 5/482, 486, 494; 297/216, 219, 486; 2/69; 296/81

[56] References Cited

U.S. PATENT DOCUMENTS

| | | | |
|---|---|---|---|
| 1,519,741 | 12/1964 | Schickerling | 296/81 |
| 3,477,065 | 11/1960 | Hoover | 2/69.5 |
| 4,142,264 | 3/1979 | Whiting | 5/482 |
| 4,383,701 | 11/1989 | Rankin et al. | 297/219 X |
| 4,478,453 | 10/1984 | Schutz | 297/219 |
| 4,568,125 | 2/1986 | Sckolnik | 297/467 |
| 4,587,671 | 5/1986 | Rodriguez, Jr. et al. | 2/69 |
| 4,611,353 | 9/1986 | Als et al. | 2/69 |
| 4,632,460 | 12/1986 | Meeker et al. | 297/467 |
| 4,685,741 | 8/1987 | Tsuge et al. | 297/467 |
| 4,745,634 | 5/1988 | Douez | 2/69 |
| 4,771,480 | 9/1988 | Stimson et al. | 2/88 |
| 4,826,242 | 5/1989 | Trethewey | 2/69 X |
| 4,840,841 | 6/1989 | Madsen | 297/219 |

*Primary Examiner*—Michael F. Trettel

*Attorney, Agent, or Firm*—Timothy H. P. Richardson

[57] ABSTRACT

A blanket for covering a child in a car seat fitted with a harness for restraining the child in the seat. The blanket comprises a plurality of apertures through which restraining members of the harness can be passed, thus enabling the harness to be fastened tightly around the child, and the blanket then to be wrapped around the child and the harness.

11 Claims, 2 Drawing Sheets

BABY BLANKET FOR USE IN CAR SEAT

BACKGROUND OF THE INVENTION

1. Field of the Invention

This invention relates to a novel blanket for use in a child's car seat (or the like) which is fitted with a restraint system.

2. Introduction to the Invention

In many situations, the use of a car seat with a restraint system is now required by law when transporting a child in a vehicle. Children meeting certain age and weight limits must be restrained in a specialized seat fastened to appropriate anchor points in the vehicle.

Modern child car seat restraint systems are designed to restrain the child's torso in the car seat, while leaving the head and limbs free to move naturally. In order to provide proper restraint, the restraining members must be tightly fitted to the child's torso.

In order to meet today's rigid safety requirements, most child car seats are equipped with a restraint system (or "harness") which has either three or five anchor points. In the three-point system, a first restraining member (or "harness element") (either a strap or a post) is anchored to the seat and extends upward between the child's legs at the crotch. Second and third harness elements are anchored to the backrest portion of the seat and extend over the left and right shoulders of the child. The three harness elements are joined together by one or more suitable buckles or clasps in front of the child's torso. The lengths of the harness elements are adjusted to hold the child's torso tightly in the car seat, while permitting free movement of the head and limbs. There are several variations of this basic three-point system. For example, the harness may be provided with a T-shaped pad at the intersection of the three harness elements; additional means may be provided for conveniently positioning the shoulder straps; and the buckle/-closure means may be located at the base of the crotch element. Various three-point systems are described in U.S. Pat. Nos. 4,632,460, 4,655,506 and 4,738,483, the disclosures of which are incorporated herein by reference.

In the five-point system, additional fourth and fifth harness elements, anchored to the seat/backrest of the car seat, extend around the lower portion of the child's torso, below the arms. These elements are joined with the first three harness elements in front of the child's torso. The fourth and fifth elements provide added restraint against lateral movement of the torso, while permitting free movement of the head and limbs. Five-point restraint systems are described in U.S. Pat. Nos. 4,679,852 and 4,685,741, the disclosures of which are incorporated by reference herein.

Proper restraint of the child is readily accomplished with both three-point and five-point harness systems, provided the child is clothed in conventional, fitted attire. However, a child that is wrapped in a blanket cannot be properly restrained. It is necessary to remove the blanket from around the child, fasten the harness around the unwrapped child, and then attempt to tuck the blanket over the child and the harness. The blanket cannot provide continuous coverage of the child's shoulders, back and buttocks. Alternatively, if the restraint harness is placed over the blanket in which the child is wrapped, the restraint cannot be properly applied. The crotch harness member cannot be properly positioned between the child's legs, and the child's arms are trapped beneath both blanket and harness.

SUMMARY OF THE INVENTION

My invention provides a novel blanket that is particularly useful for covering a child in a car seat fitted with a restraint system, but which can also be used for other purposes, for example to cover a patient or invalid who is restrained on a bed or in a wheelchair.

In one aspect, the present invention provides a blanket for wrapping a child restrained in a child's car seat, the car seat being equipped with a plurality of restraining members which are anchored to the car seat at spaced-apart locations and which can be releasably secured to each other to provide a restraining harness around a child placed in the seat, the blanket comprising a plurality of apertures through which said restraining members can be passed so that, when a child is restrained in the seat, the blanket comprises (a) an interior portion which lies between the child and the seat and which comprises the apertures through which the restraining members pass, and (b) an exterior portion which can be wrapped around the child outside the restraining members after the restraining members have been secured to each other to provide the restraining harness around the child.

A novel blanket as described above can be placed in the car seat, with the restraining members having been passed through it, ready for a child to be placed in the seat on top of the interior portion of the blanket; after the child has been placed in the seat, the restraining members are secured to each other around the child, and the exterior portion of the blanket is wrapped around the child. Alternatively, and usually preferably, the child can first be wrapped in the blanket, e.g. inside the house, and then placed in the car seat; the blanket can then be unwrapped sufficiently to allow the restraining members to be pulled through the apertures and secured together; and finally the blanket can be rewrapped around the child. Similarly, when a child wrapped in one of the novel blankets is to be removed from the car seat, the blanket can be unwrapped, the restraining members separated, and the child removed, leaving the blanket in the car seat. Alternatively, and usually preferably, the blanket can be unwrapped only to the extent needed for access to the release mechanism which allows the restraining members to be separated; the restraining members are separated; and the child and the blanket are then removed together, the restraining members passing through the apertures of the blanket as this is done.

BRIEF DESCRIPTION OF THE DRAWING

The invention is illustrated in the accompanying drawing, in which.

DETAILED DESCRIPTION OF THE INVENTION

The apertures in the blankets of the invention, through which the restraining members are passed, can be the same (except of course that they are at different locations) or different. Each can have a closed perimeter (e.g. like an oversized buttonhole) or an open perimeter, i.e. it can be an opening which extends to an edge of the blanket. Preferably at least one of the apertures, particularly each of the apertures, is an opening in the form of a slit, the term "slit" being used herein to denote an opening having edges which, when the blanket is spread out on a flat surface, meet or overlap. A slit can conveniently be made by a process which includes cutting the blanket without removing any material from the blanket. The slit can be in the form of a straight line or of more complex shape, e.g. a combination of straight lines, e.g. a chevron, zig-zag, or T-shape, or one or more curved lines, e.g. a semicircle, or a combination of one or more straight lines and one or more curved lines. The minimum size of the aperture is determined by the size of the restraining member (including any buckle, clasp or other closure member attached thereto) which must pass through the apertures. The aperture can of course be larger than the minimum, for easier passage of the restraining member therethrough, or so that two (or even more) restraining members can be passed through the same aperture) or to accommodate a variety of different harnesses and car seats. The aperture is preferably at least 3 inches long when a single restraining member is to be passed through it, and at least 8 inches long when two restraining members are to be passed through it. There can be a set of two or more relatively closely spaced apertures at one or more of the relatively widely spaced locations corresponding to each of the three or five restraining members, to allow the user to select the aperture which is most appropriate aperture for the particular child and harness. The axes of each aperture can be parallel to an edge of the blanket or at an angle, e.g. 45°, thereto.

Especially when the aperture is larger than the required minimum, the blanket preferably comprises at least one closure member for releasably securing edges of the aperture together. The closure member can be for example a press stud or other mechanical snap, which is often preferred, a zipper, a button and button-hole, or a Velcro-type closure ("Velcro" is a registered trademark). The closure member can secure the edges of the aperture in an overlapping relationship, or can include a fabric flap to cover the gap between the edges of the aperture. The closure member can be used to help in maintaining the blanket in a desired position in the car seat and/or to ensure that the child is snugly surrounded by the blanket either in or out of a car seat.

In one embodiment of the invention, at least two of the apertures are slits having straight line longitudinal axes which are substantially parallel to each other.

Figure 7:
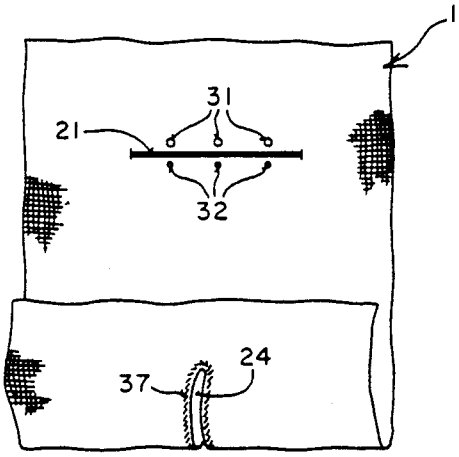

In another embodiment, one edge portion of the blanket is of double thickness, formed by folding over an edge of a conventional blanket. The folded portion has an aperture therein which extends from the fold line towards the center of the blanket; the edges of the blanket around the perimeter of the aperture are preferably permanently joined together, e.g. by sewing. Such an aperture is particularly suitable for the restraining member which passes between the legs of the child. An example of such a blanket is shown in FIG. 7.

The blanket can have markings thereon to assist the user in wrapping it around a child in the appropriate way for subsequently placing the wrapped child into a car seat.

Figure 1:
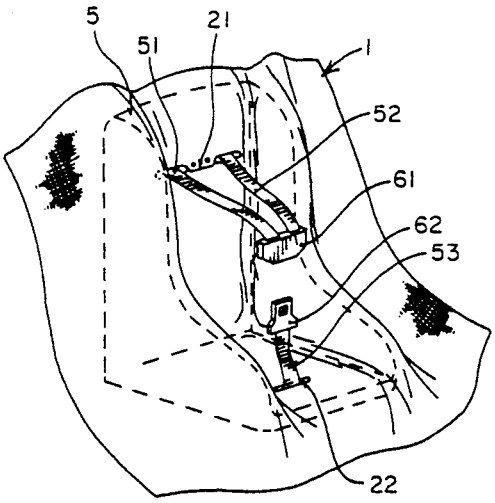
FIG. 1 is a diagrammatic perspective view of a blanket according to the invention placed on a child's car seat equipped with a three-point harness system.
Figure 2:
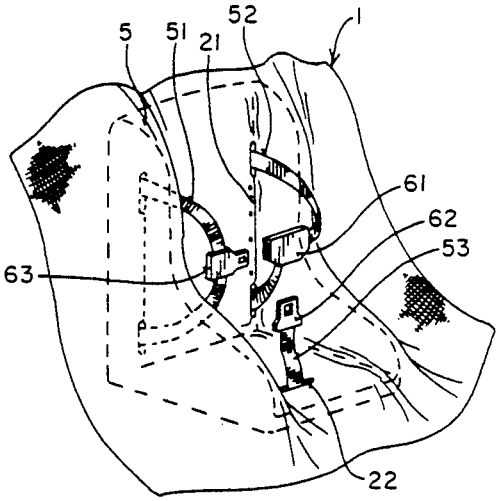
FIG. 2 is a diagrammatic perspective view of another blanket according to the invention, placed on a child's car seat equipped with a five-point harness system.

Referring now to the drawing, the various Figures employ the same reference numeral for similar components. Thus in each Figure there is a blanket 1 having apertures 21, 22, 23, etc. therein, the edges of apertures being releasably securable to each other by means of closure members 31, 32, 33, etc. FIGS. 1 and 2 also show a child car seat 5 to which restraining members 51, 52, 53 etc. are anchored, the restraining members comprising closure elements 61, 62, 63 etc. which can be releasably secured to each other to provide a harness.

FIG. 1 shows a blanket 1 of the invention placed over a car seat 5 equipped with restraining members 51, 52 and 53 which can be releasably secured to each other through buckle components 61 and 62 to provide a three-point harness, and which pass through apertures 21 and 22 in the blanket 1.

FIG. 2 is similar to FIG. 1 except that the car seat is equipped with a five-point harness, and the blanket is correspondingly adapted.

Figure 3:
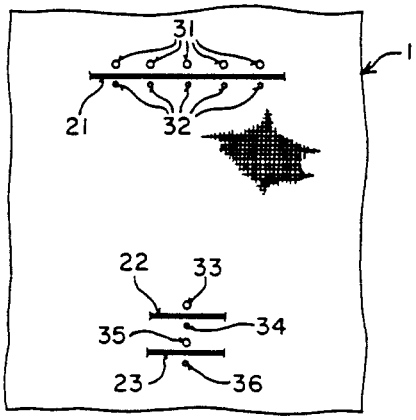
FIGS. 3 to 9 are plan views of various blankets according to the invention.

FIG. 3 shows a blanket 1 suitable for use in a car seat equipped with a three-point harness. Upper slit aperture 21 has a closed perimeter, is long enough to allow the two upper restraining members to pass through it, and is closable by means of press studs 31 and 32. There are also two lower slit apertures 22 and 23, also of closed perimeter, through one of which the lower restraining member passes, the user selecting whichever of the apertures is more convenient. These lower apertures are likewise closable by means of press studs 33, 34 and 35, 36.

Figure 4:
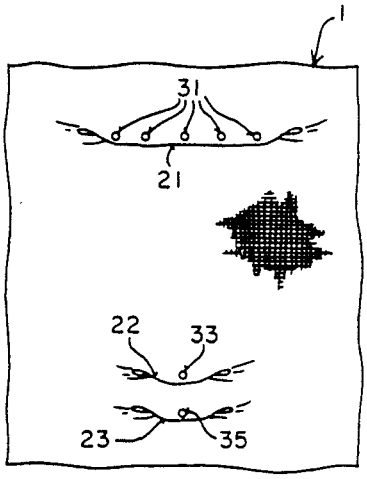

FIG. 4 shows the blanket of FIG. 3 with the apertures closed by means of the press studs.

Figure 5:
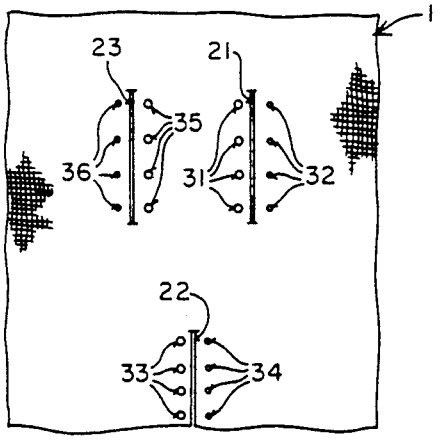

FIG. 5 shows a blanket 1 suitable for use in a car seat equipped with a three-point or a five-point harness. Each of slit apertures 21 and 23 has a closed perimeter, is long enough to allow two restraining members to pass through it, one above the other, and is closable by means of press studs 31, 32 and 35, 36. Lower slit aperture 22 has an open perimeter, is in the form of an opening which extends to the lower edge of the blanket, and is closable by means of press studs 33, 34.

Figure 6:
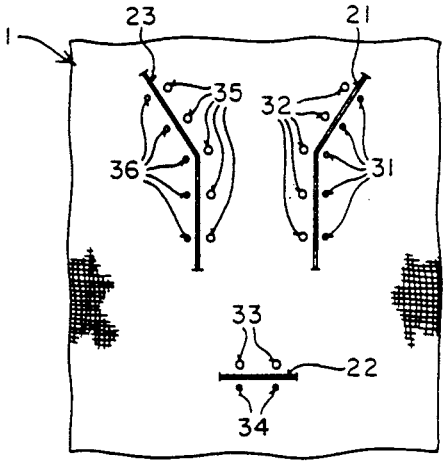

FIG. 6 shows another blanket 6 suitable for use in a car seat equipped with a three-point or a five-point harness. Slit apertures 21 and 23 are as in FIG. 5 except that they are not straight. Lower slit aperture 22 is as in FIG. 5 except that it is horizontal and has a closed perimeter.

FIG. 7 shows a blanket suitable for use in a car seat equipped with a three-point harness. Upper slit aperture 21 is as in FIG. 3. Lower aperture 7 is formed by folding the lower edge of a blanket upwards, cutting an aperture upwards from the fold, and stitching along the line 37.

Figure 8:
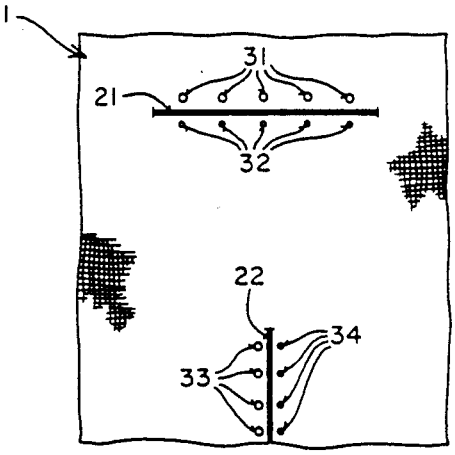

FIG. 8 also shows a blanket suitable for use in a car seat equipped with a three-point harness. Upper slit aperture 21 is as in FIG. 3. Lower slit aperture is as in FIG. 5.

Figure 9:
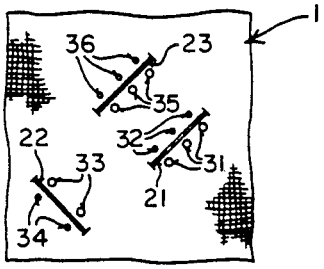

FIG. 9 shows a blanket which is suitable for use in a car seat equipped with a three-point or with a five-point harness and in which the apertures are slits of closed perimeter at an angle of 45° to the borders of the blanket.

Side views of the blankets of the invention, for example of the blankets shown in FIGS. 3–9, are not included herein since such view would merely be two straight lines with minor additions where there are closure members and with short vertical lines where an aperture extends to the edge being viewed.

The invention is further illustrated by the following Examples.

EXAMPLES

Example 1

A blanket substantially as illustrated in FIG. 3 was made as follows.

A rectangular fabric blanket forty inches in length and thirty-eight inches in width was provided with three slit-type apertures. Each of the three apertures was centered upon and at right angles to the longitudinal center line of the blanket. First and second apertures, each three inches in length were located ten inches and fourteen inches, respectively, from the first end of the blanket. Such first and second aperture was equipped with a two-piece mechanical snap closure, located at the aperture mid-point. The third aperture was twelve inches in length and was located thirty-three inches from the first end of the blanket. This third aperture was equipped with three two-piece snap closures equally spaced three inches from each other, and from the ends of the aperture.

The blanket of Example 1 was demonstrated to fit several makes and models of car seats, including the following:

Century STE Elite 5000, 3000 and 2000 models

Evenflo Ultra, Joyride, Dynomite and Premium Line models

Fisher-Price M9101 Car Seat and M9149 Infant Car Seat

Example 2

A blanket substantially as illustrated in FIG. 5 was made as follows.

A rectangular fabric blanket, forty inches in length and thirty-eight inches in width was provided with three slit-type apertures, each aperture running parallel with the longitudinal axis of the blanket. The first aperture was located coincident with the longitudinal center line of the blanket, and extended from the first end of the blanket for a length of fourteen inches. The first aperture was equipped with four two-piece snap closures, spaced approximately equally along the length of the aperture. The second and third apertures were located six inches to the left and right, respectively, of the longitudinal center line of the blanket. They were positioned with their first ends sixteen inches from the first end of the blanket. These second and third apertures were each fifteen inches in length, their second ends located thirty-one inches from the first end of the blanket. Each of these apertures was equipped with four two-piece closures equally spaced three inches from each other and from the first and second ends of these apertures.

The blanket of Example 2 was demonstrated to fit several makes and models of car seats, including the following:

Renolux 5-point Models 2000, 4000, 50000 and 7000

I claim:

1. A blanket for wrapping a child restrained in a child's car seat, the car seat being equipped with a plurality of restraining members which are anchored to the car seat at spaced-apart locations and which can be releasably secured to each other to provide a restraining harness around a child placed in the seat, the blanket comprising a plurality of apertures through which said restraining members can be passed so that, when a child is restrained in the seat, the blanket comprises (a) an interior portion which lies between the child and the seat and which comprises the apertures through which the restraining members pass, and (b) an exterior portion having a width such that it can be wrapped around and cover the child outside the restraining members after the restraining members have been secured to each other to provide the restraining harness around the child.

2. A blanket according to claim 1 wherein at least one of the apertures is an opening which extends to an edge of the blanket.

3. A blanket according to claim 2 wherein the opening is in the form of a slit and which further comprises at least one closure member for releasably securing edges of the slit together.

4. A blanket according to claim 1 wherein at least one of the apertures is in the form of an opening which has a closed perimeter.

5. A blanket according to claim 4 wherein the opening is in the form of a slit and which further comprises at least one closure member for releasably securing edges of the slit together.

6. A blanket according to claim 1 wherein at least one of the apertures is long enough to permit at least two restraining members to pass through it.

7. A blanket according to claim 1 which comprises at least one closure member for releasably securing edges of one of the apertures together.

8. A blanket according to claim 1 wherein each of the apertures is in the form of a slit.

9. A blanket according to claim 1 which is substantially flat when it is completely unwrapped.

10. A blanket according to claim 9 which is substantially rectangular when it is completely unwrapped.

11. A blanket according to claim 1 which is a single layer of fabric.

* * * * *